US008474945B2

(12) United States Patent
Murray

(10) Patent No.: US 8,474,945 B2
(45) Date of Patent: Jul. 2, 2013

(54) DISLODGING AND REMOVING BUBBLES FROM INKJET PRINTHEAD

(75) Inventor: Richard A. Murray, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 134 days.

(21) Appl. No.: 13/222,156

(22) Filed: Aug. 31, 2011

(65) Prior Publication Data

US 2013/0050312 A1 Feb. 28, 2013

(51) Int. Cl.
*B41J 29/393* (2006.01)

(52) U.S. Cl.
USPC ..... 347/19; 347/37; 347/92; 347/94

(58) Field of Classification Search
USPC ..... 347/7, 14, 17, 19, 20, 29–32, 39, 347/84–87, 92–94
See application file for complete search history.

(56) References Cited

U.S. PATENT DOCUMENTS 4,301,459 A * 11/1981 Isayama et al. ..... 347/19
5,394,181 A 2/1995 Braun
6,007,193 A 12/1999 Kashimura et al.
6,036,299 A 3/2000 Kobayashi et al.
6,231,174 B1 5/2001 Haigo
6,305,778 B1 10/2001 Kobayashi et al.
6,805,426 B2 * 10/2004 Kokubo et al. ..... 347/19
7,350,902 B2 4/2008 Dietl et al.
7,690,753 B2 * 4/2010 Sakurai ..... 347/19
2002/0106812 A1 8/2002 Fisher
2009/0174733 A1 7/2009 Balcan
2010/0054835 A1 3/2010 Hayashi

* cited by examiner

*Primary Examiner* — Juanita D Jackson
(74) *Attorney, Agent, or Firm* — Peyton C. Watkins

(57) ABSTRACT

A method of operating an inkjet printer including an inkjet printhead having an ink inlet, the inkjet printhead mounted on a motor-driven carriage having an encoder sensor, the method including sending a signal from the encoder sensor to a controller to indicate a position of the motor-driven carriage; determining a velocity of the motor-driven carriage; implementing a first motion control mode during a period when the inkjet printhead is printing, wherein the first motion control mode includes a first signal for damping vibrations in order to provide a substantially constant velocity of the carriage; selectively implementing a second motion control mode when the inkjet printhead is not printing, wherein the second motion control mode includes a second signal for enhancing vibrations of the carriage in order to dislodge air bubbles in the printhead; and removing air corresponding to the air bubbles from the printhead.

25 Claims, 13 Drawing Sheets

DISLODGING AND REMOVING BUBBLES FROM INKJET PRINTHEAD

CROSS-REFERENCE TO RELATED APPLICATIONS

Reference is made to commonly assigned, co-pending U.S. patent applications:

- U.S. patent application Ser. No. 13/222,129, filed concurrently herewith, entitled: "CARRIAGE PRINTER WITH BUBBLE DISLODGING AND REMOVAL", by Richard A. Murray, the disclosure of which is incorporated by reference herein in its entirety;
- U.S. patent application Ser. No. 13/095,998, filed Apr. 28, 2011, entitled: "AIR EXTRACTION PISTON DEVICE FOR INKJET PRINTHEAD", by Richard A. Murray, the disclosure of which is incorporated by reference herein in its entirety;
- U.S. patent application Ser. No. 13/096,101, filed Apr. 28, 2011, entitled: "AIR EXTRACTION METHOD FOR INKJET PRINTHEAD", by Richard A. Murray, the disclosure of which is incorporated by reference herein in its entirety;
- U.S. patent application Ser. No. 12/614,481, filed Nov. 9, 2009, entitled: "AIR EXTRACTION PRINTER", by Richard A. Murray, the disclosure of which is incorporated by reference herein in its entirety;
- U.S. patent application Ser. No. 12/614,476, filed Nov. 9, 2009, entitled: "AIR EXTRACTION DEVICE FOR INKJET PRINTHEAD", by Richard A. Murray, the disclosure of which is incorporated by reference herein in its entirety;
- U.S. patent application Ser. No. 12/614,483, filed Nov. 9, 2009, entitled: "AIR EXTRACTION METHOD FOR INKJET PRINTER", by Richard A. Murray, the disclosure of which is incorporated by reference herein in its entirety; and
- U.S. patent application Ser. No. 12/614,487, filed Nov. 9, 2009, entitled: "INK CHAMBERS FOR INKJET PRINTER", by Richard A. Murray; the disclosure of which is incorporated by reference herein in its entirety.

FIELD OF THE INVENTION

This invention relates generally to the field of inkjet printing, and in particular to dislodging and removing air bubbles from the printhead while in the printer.

BACKGROUND OF THE INVENTION

An inkjet printing system typically includes one or more printheads and their corresponding ink supplies. A printhead includes an ink inlet that is connected to its ink supply and an array of drop ejectors, each ejector including an ink pressurization chamber, an ejecting actuator and a nozzle through which droplets of ink are ejected. The ejecting actuator can be one of various types, including a heater that vaporizes some of the ink in the chamber in order to propel a droplet out of the nozzle, or a piezoelectric device that changes the wall geometry of the ink pressurization chamber in order to produce a pressure wave that ejects a droplet. The droplets are typically directed toward paper or other print medium (sometimes generically referred to as recording medium or paper herein) in order to produce an image according to image data that is converted into electronic firing pulses for the drop ejectors as the print medium is moved relative to the printhead.

Motion of the print medium relative to the printhead can include keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads. A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a carriage scan direction that is substantially perpendicular to the print medium advance direction as the drops are ejected from the nozzles. After the carriage has printed a swath of the image while traversing the print medium, the print medium is advanced, the carriage direction of motion is reversed, and the image is formed swath by swath.

Inkjet ink includes a variety of volatile and nonvolatile components including pigments or dyes, humectants, image durability enhancers, and carriers or solvents. A key consideration in ink formulation and ink delivery is the ability to produce high quality images on the print medium. Image quality can be degraded if air bubbles block the small ink passageways from the ink supply to the array of drop ejectors. Such air bubbles can cause ejected drops to be misdirected from their intended flight paths, or to have a smaller drop volume than intended, or to fail to eject. Air bubbles can arise from a variety of sources. Air that enters the ink supply through a non-airtight enclosure can be dissolved in the ink, and subsequently be exsolved (i.e. come out of solution) from the ink in the printhead at an elevated operating temperature, for example. Air can also be ingested through the printhead nozzles. For a printhead having replaceable ink supplies, such as ink tanks, air can also enter the printhead when an ink tank is changed.

In a conventional inkjet printer, a part of the printhead maintenance station is a cap that is connected to a suction pump, such as a peristaltic or tube pump. The cap surrounds the printhead nozzle face during periods of nonprinting in order to inhibit evaporation of the volatile components of the ink. Periodically, the suction pump is activated to remove ink and unwanted air bubbles from the nozzles. This pumping of ink through the nozzles is not a very efficient process and wastes a significant amount of ink over the life of the printer. Not only is ink wasted, but in addition, a waste pad is typically be provided in the printer to absorb the ink removed by suction. The waste ink and the waste pad are undesirable expenses. In addition, the waste pad takes up space in the printer, requiring a larger printer volume. Furthermore the waste ink and the waste pad must be subsequently disposed. Also, the suction operation can delay the printing operation by several seconds or more. Still further, some air bubbles can be stuck on physical surfaces near the printhead inlet and are not always removed in a single priming operation, so that additional suction cycles can be attempted by the user, wasting additional ink.

What is needed is a carriage printer having the capability for dislodging and removing air bubbles from an inkjet printhead with little or no waste of ink, and that furthermore is compatible with a compact printer architecture, low cost, environmentally friendly, and that does not delay the printing operation significantly.

SUMMARY OF THE INVENTION

The present invention is directed to overcoming one or more of the problems set forth above. Briefly summarized, according to one aspect of the invention, the invention resides in a method of operating an inkjet printer including an inkjet printhead having an ink inlet, the inkjet printhead mounted on a motor-driven carriage having an encoder sensor, the method comprising sending a signal from the encoder sensor to a controller to indicate a position of the motor-driven carriage; determining a velocity of the motor-driven carriage; implementing a first motion control mode during a period when the inkjet printhead is printing, wherein the first motion control mode includes a first signal for damping vibrations in order to provide a substantially constant velocity of the carriage; selectively implementing a second motion control mode when the inkjet printhead is not printing, wherein the second motion control mode includes a second signal for enhancing vibrations of the carriage in order to dislodge air bubbles in the printhead; and removing air corresponding to the air bubbles from the printhead.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
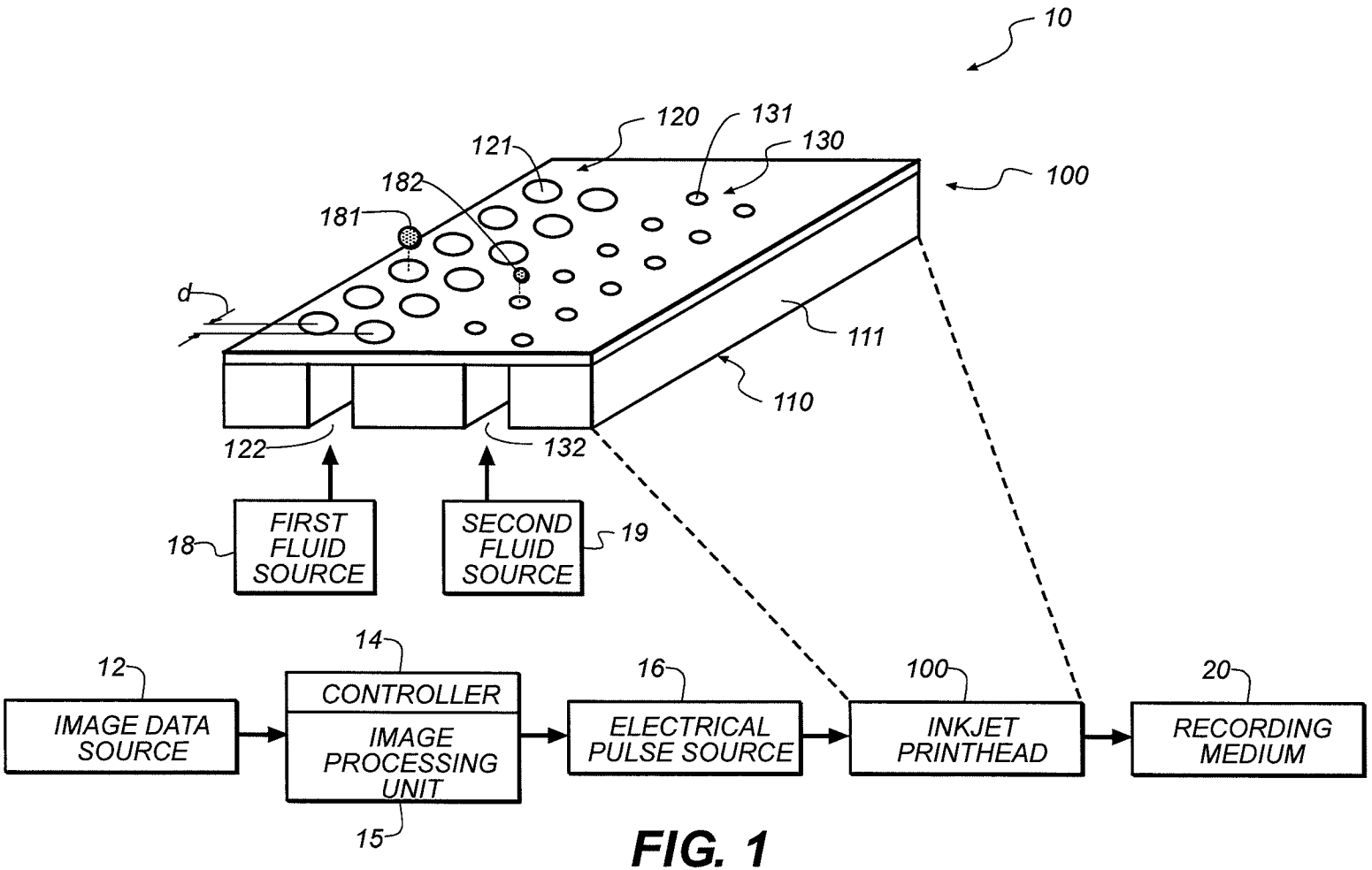
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays 120, 130 has two staggered rows of nozzles 121, 131, each row having a nozzle density of 600 per inch. The effective nozzle density then in each array is 1200 per inch (i.e. $d=1/1200$ inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array 120, 130 is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it can be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20. As the nozzles are the most visible part of the drop ejector, the terms drop ejector array and nozzle array will sometimes be used interchangeably herein.

Figure 2:
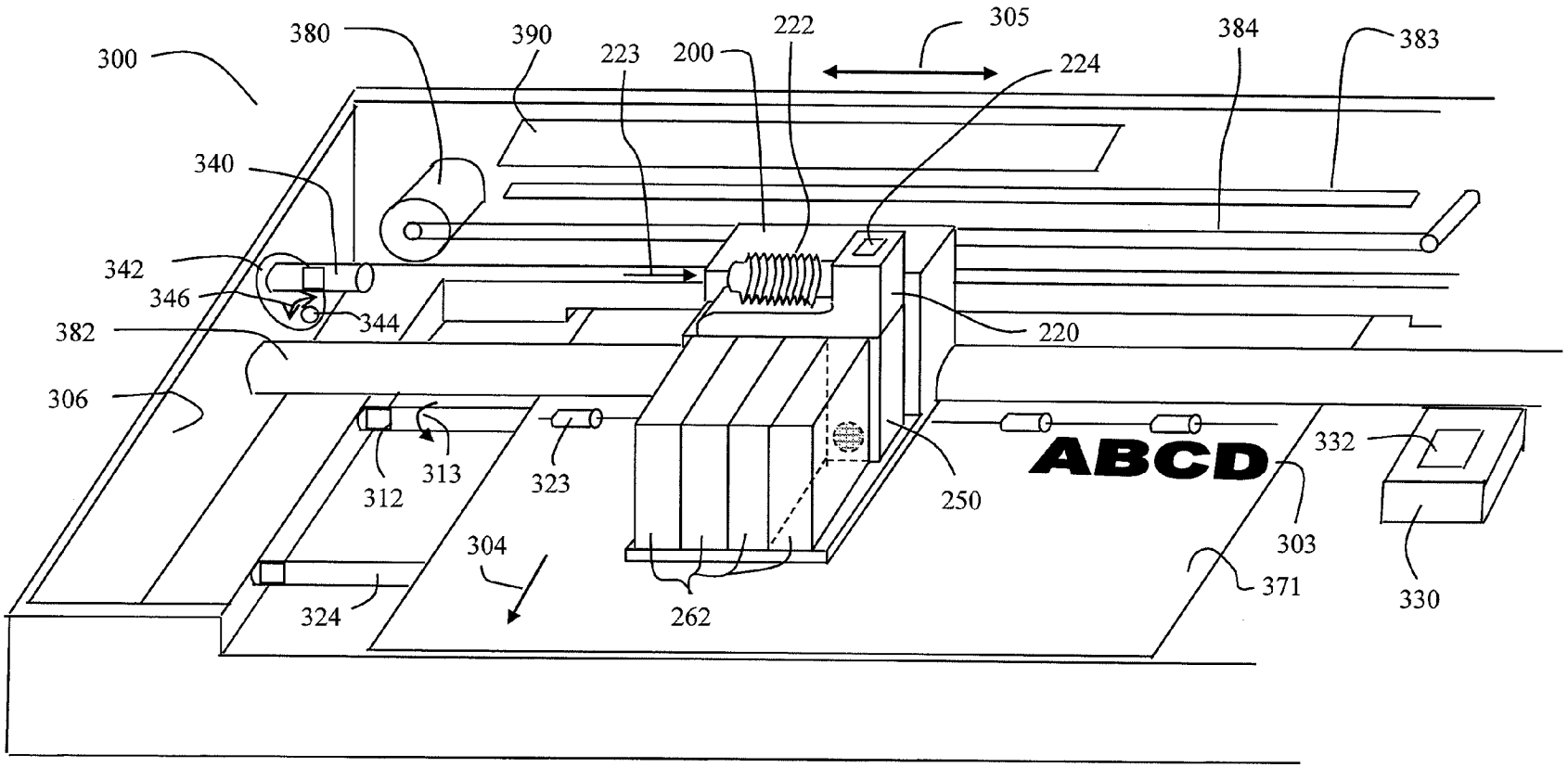
FIG. 2 is a schematic perspective of a portion of a carriage printer.

FIG. 2 shows a schematic perspective of a portion of a desktop carriage printer. Some of the parts of the printer have been hidden in the view shown in FIG. 2 so that other parts can be more clearly seen. Printer chassis 300 has a print region 303 across which carriage 200 is moved back and forth in carriage scan direction 305, while drops of ink are ejected from inkjet printhead 250 that is mounted on carriage 200. The letters ABCD indicate a portion of an image that has been printed in print region 303 on a piece 371 of paper or other recording medium. Carriage motor 380 moves belt 384 attached to carriage 200 in order to move carriage 200 along carriage guide rod 382. An encoder sensor (not shown in FIG. 2) is mounted on carriage 200 and indicates carriage location relative to a linear encoder 383 disposed along the carriage scan direction 305. Signals are provided by the encoder sensor 385 to the controller 14 (FIG. 13) in order to control the position and velocity of carriage 200 by controlling carriage motor 380. As described below, when the printhead 250 is printing in print region 303 the velocity of carriage 200 is controlled using a first motion control mode to damp out vibrations in the carriage motion so that print quality is not degraded. In addition, according to embodiments of the present invention, a second motion control mode is implemented selectively when the printhead 250 is not printing, such that vibrations of the carriage 200 are enhanced in order to dislodge air bubbles in printhead 250 so that they can be subsequently removed. The motion control and vibrating the carriage 200 to dislodge air bubbles will be described below after first providing additional details about the inkjet printer and ways to remove air including the air bubbles that are dislodged by vibrating carriage 200.

Printhead 250 is mounted in carriage 200, and ink tanks 262 are mounted to supply ink to printhead 250, and contain inks such as cyan, magenta, yellow and black, or other recording fluids. Optionally, several ink tanks can be bundled together as one multi-chamber ink supply, for example, cyan, magenta and yellow. Inks from the different ink tanks 262 are provided to different nozzle arrays, as described in more detail below.

A variety of rollers are used to advance the recording medium through the printer. In the view of FIG. 2, feed roller 312 and passive roller(s) 323 advance piece 371 of recording medium along media advance direction 304, which is substantially perpendicular to carriage scan direction 305 across print region 303 in order to position the recording medium for the next swath of the image to be printed. Discharge roller 324 continues to advance piece 371 of recording medium toward an output region where the printed medium can be retrieved. Star wheels (not shown) hold piece 371 of recording medium against discharge roller 324.

Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the piece 371 of recording medium. Following the printing of a swath, the recording medium 20 is advanced along media advance direction 304. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller 312. The motor that powers the paper advance rollers, including feed roller 312 and discharge roller 324, is not shown in FIG. 2. For normal paper feeding feed roller 312 and discharge roller 324 are driven in forward rotation direction 313.

Toward the rear of the printer chassis 300, in this example, is located the electronics board 390, which includes cable connectors for communicating via cables (not shown) to the printhead carriage 200 and from there to the printhead 250. Also on the electronics board are typically mounted motor controllers for the carriage motor 380 and for the paper advance motor, a processor or other control electronics (shown schematically as controller 14 and image processing unit 15 in FIG. 1) for controlling the printing process, and an optional connector for a cable to a host computer.

Toward the right side of the printer chassis 300, in the example of FIG. 2, is the maintenance station 330. Maintenance station 330 can include a wiper (not shown) to clean the nozzle face of printhead 250, as well as a cap 332 to seal against the nozzle face in order to slow the evaporation of volatile components of the ink. Many conventional printers include a vacuum pump attached to the cap in order to suck ink and air out of the nozzles of printhead when they are malfunctioning.

A different way to remove air from the printhead 250 is shown in FIG. 2. Air extraction chamber 220 is attached to printhead 250. A compressible member such as a bellows 222 is part of air extraction chamber 220. As bellows 222 is compressed, it forces air out of the air extraction chamber 220 through one-way relief valve 224. Bellows 222 is configured such that it tends to expand by itself from a compressed state. As bellows 222 expands, it provides a reduced air pressure in the air extraction chamber 220, which extracts air from printhead 250 as discussed in more detail below. Bellows 222 is mounted so that it is compressible along a compression direction 223 substantially parallel to carriage scan direction 305. Bellows 222 is in line with a compressing member, such as a projection 340 extending, for example, from a wall 306 of printer chassis 300. In order to compress bellows 222, carriage 200 is moved toward wall 306 until projection 340 engages bellows 222. Because the position of carriage 200 is tracked relative to linear encoder 383, the amount of movement of carriage 200 toward wall 306 can be precisely controlled, thereby controlling the amount of compression of bellows 222 by projection 340 as the carriage 200 moves toward wall 306. Carriage 200 can be controlled to move bellows 222 to a predetermined position relative to projection 340, such that carriage 200 is moved by a predetermined distance after the bellows 222 strikes projection 340. Controller 14 (see FIG. 1) can include instructions to determine when it should send a signal to carriage motor 380 to move carriage 200 toward wall 306 to engage projection 340 with bellows 222 for compression. After the desired amount of compression of bellows 222 has been achieved, controller 14 can send a signal to carriage motor 380 to move carriage 200 away from the wall 306. Bellows 222 can remain partially in compression for an extended period of time as it slowly expands, thereby continuing to provide a reduced air pressure in air extraction chamber 220.

Projection 340 is located near one end of the carriage scan path. In some embodiments, as in FIG. 2, maintenance station 330 is located at the opposite end of the carriage scan path along carriage scan direction 305. In order to decrease the required width of printer chassis 300 needed to accommodate projection 340, in some embodiments, as in FIG. 2, projection 340 is attached to a movable projection mount 342 that can permit projection 340 to be moved into and out of engageable alignment with bellows 222, so that the carriage 200 can be brought closer to wall 306 without projection 340 engaging bellows 222. In the embodiment shown in FIG. 2, projection mount 342 is eccentrically attached to wall 306 by shaft 344. Projection mount 342 can be rotated about shaft 344 back and forth as indicated by rotation direction arrow 346. When the projection mount 342 is in the position shown in FIG. 2, projection 340 is in alignment to engage bellows 222. When the projection mount 342 is rotated to the position shown in FIG. 3, projection 340 is out of alignment and will not engage bellows 222. Because rotation direction 346 is along the forward 313 and reverse directions of feed roller 312, it is straightforward to rotate projection mount 340 using the same motor used to advance to feed roller 312, using a selectively connectable linkage such as a gear train or belt (not shown). US Patent Application Publication 20090174733, incorporated herein by reference in its entirety, discloses an apparatus and method of driving multiple printer functions using the same motor, which can be used to selectively disengage power from the feed roller 312 and use that motor to move the projection 340 in and out of the path of the bellows 222 as needed. Controller 14 (see FIG. 1) can include instructions regarding when it should send a signal to move the projection 340 into or out of engageable alignment with bellows 222.

Instructions for controller 14 to move carriage 200 or to move projection 340 such that bellows 222 strikes projection 340 and is compressed can be event-based, clock-based, count-based, sensor-based or a combination of these. Examples of an event-based instruction would be for controller 14 to send appropriate signals to cause bellows 222 to be compressed when the printer is turned on, or just before or after a maintenance operation (such as wiping) is performed, or after the last page of a print job is printed. An example of a clock-based instruction would be for the controller to send appropriate signals to cause bellows 222 to be compressed one hour after the last time the bellows 222 were compressed. Examples of a count-based instruction would be for controller 14 to send appropriate signals to cause bellows 222 to be compressed after a predetermined number of pages were printed, or after a predetermined number of maintenance cycles were performed, or after the carriage 200 is vibrated to dislodge air bubbles. Examples of a sensor-based instruction would be for controller 14 to send appropriate signals to cause bellows 222 to be compressed when an optical sensor detects that one or more jets are malfunctioning, or when a thermal sensor indicates that the printhead has exceeded a predetermined temperature. An example of a combination-based instruction would be for controller to send appropriate signals to cause bellows 222 to be compressed when a thermal sensor and a clock 30 indicate that the printhead has been above a predetermined temperature for longer than a predetermined length of time. Instructions from controller 14 can be either to cause full compression or no compression of bellows 222, or alternatively can cause bellows 222 to be compressed by one of a plurality of predetermined amounts, by moving carriage 200 by corresponding amounts, as monitored relative to linear encoder 383.

Because air that is dissolved in the ink tends to exsolve, that is to come out of solution when the ink is raised to elevated temperatures, in some cases the method of extracting air from the printhead 250 can include heating a portion of the printhead 250 in conjunction with applying reduced air pressure via the air extraction chamber 220. This is particularly straightforward for a thermal inkjet printhead including a printhead die having drop ejectors that include heaters to vaporize ink in order to eject droplets of ink from the nozzles. Electrical pulses to heat the heaters can be of sufficient amplitude and duration that they cause drops to be ejected, or electrical pulses can be below a drop firing threshold. In various cases, controller 14 can cause firing pulses or nonfiring pulses to heat the printhead die 251 before or during the time when bellows 222 is permitted to expand and thereby provide reduced pressure at air extraction chamber 220 in order to draw exsolved air out of the printhead 250.

Figure 4B:
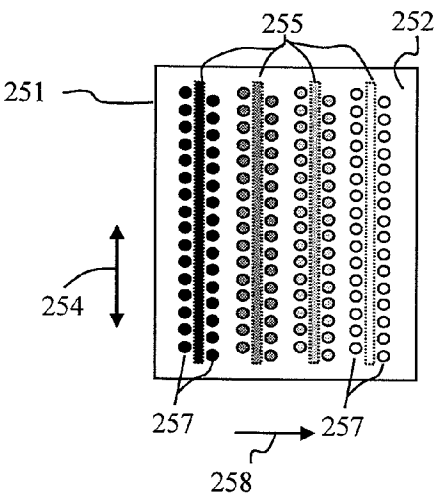
FIG. 4B is a nozzle face view of a printhead die that can be used in the printhead of FIG. 4A.
Figure 4A:
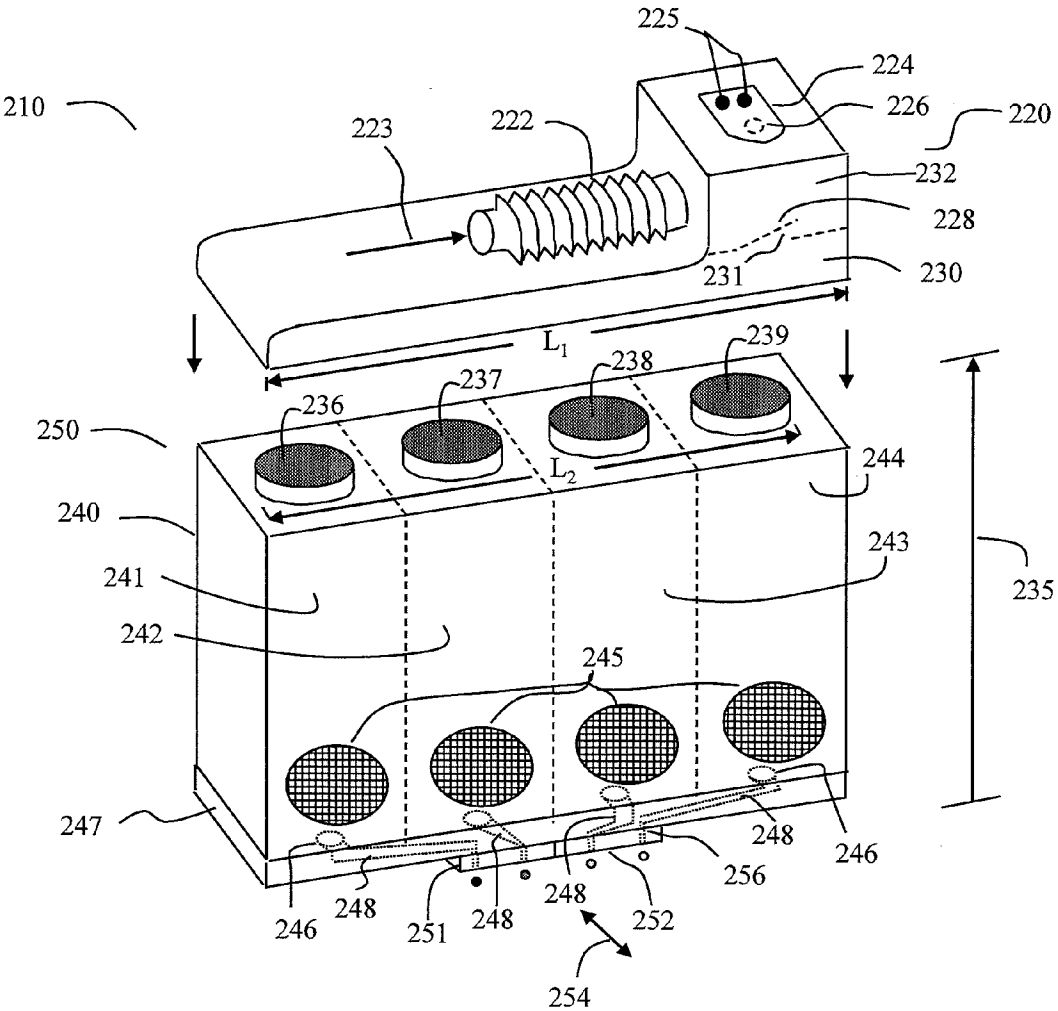
FIG. 4A is a perspective exploded front view of a printhead assembly including a printhead with an air extraction chamber.

Printhead 250 and air extraction chamber 220 are shown in more detail in FIG. 4A. The term printhead assembly 210, when used herein, will include printhead 250 and its component parts, as well as air extraction chamber 220 and its component parts. The downward arrows below air extraction chamber 220 indicate how it assembles together with printhead 250. Additional parts of air extraction chamber 220 shown in FIG. 4A include a one-way containment valve 228 separating air extraction chamber 220 into an air accumulation chamber 230 and an air expulsion chamber 232. In addition, an example of a flapper valve as one-way relief valve 224 is shown. Fastener(s) 225 connect the flapper valve to an outer surface of air extraction chamber 220. The flapper valve typically is made of an elastomeric sheet, which in its normal state covers and seals air vent 226 in the air expulsion chamber 232. Likewise, one-way containment valve 228 can also be a flapper valve that seals and covers air passage 231. Normally, one-way relief valve 224 and one-way containment valve 228 are both closed. When the pressure in air expulsion chamber 232 is greater than ambient pressure by a sufficient amount to force one-way relief valve 224 to an open position, a quantity of air is expelled from air expulsion chamber 232 through one-way relief valve 224. Then elastomeric restoring forces close the one-way relief valve 224 again, so that air can no longer be vented through air vent 226. Similarly, when the pressure in air accumulation chamber 230 is greater than the pressure in air expulsion chamber 232 by a sufficient amount to force one-way containment valve 228 open, air is transferred from air accumulation chamber 230 to air expulsion chamber 232 through air passage 231. Then elastomeric restoring forces close the one-way containment valve 228 again.

Printhead 250 includes a printhead body 240 having a plurality of ink reservoirs. In the example shown in FIG. 4A, ink reservoirs 241, 242, 243 and 244 contain black, cyan, magenta, and yellow ink respectively. Other configurations can have more than four ink reservoirs or fewer than four ink reservoirs. Ink enters the ink reservoirs 241-244 by their respective inlet ports 245, which optionally can be covered by filters in order to keep contaminants such as particulate debris out of the ink reservoirs. At the top of each ink reservoir 241, 242, 243 and 244 is a corresponding membrane 236, 237, 238 and 239 respectively. Membranes 236-239 are permeable to air but not permeable to liquid. In other words, air can pass through membranes 236-239, but ink cannot pass through.

Ink exits ink reservoirs 241-244 through respective ink outlets 246 in order to provide ink to printhead die 251. Printhead die 251 contain nozzle arrays 257 (FIG. 4B) on nozzle face 252, with different nozzle arrays supplied with ink from different ink reservoirs 241-244. In FIG. 4A there are two printhead die 251, each containing two nozzle arrays. In FIG. 4B, all four nozzle arrays 257 are alternatively shown on one printhead die 251. Nozzle arrays 257 are disposed along an array direction 254, with arrays separated from each other along an array separation direction 258. Typically, in order to reduce cost of the printhead die 251, it is desired to keep the total width along the array separation direction 258 relatively small compared to the width of the printhead body 240 along that direction. In some configurations, as in FIG. 4A, a manifold 247 is used to bring ink from the ink outlets 246 of each ink reservoir 241-244 to the corresponding ink inlets 256 on the side of printhead die 251 that is opposite the nozzle face 252. Ink flows from the ink inlets 256 to the corresponding ink feeds 255 (FIG. 4B) and from there to the respective nozzle arrays 257. The small circles below printhead die 251 in FIG. 4A represent droplets of different color inks ejected from the different nozzle arrays 257. For inner ink reservoirs 242 and 243, which are located substantially vertically above printhead die 251 in the example of FIG. 4A, the corresponding manifold passageways 248 from printhead die 251 to printhead ink outlets 246 can be substantially vertical. For the outer ink reservoirs 241 and 244, the corresponding manifold passageways 248 can have more extensive horizontal or slightly inclined portions. Printhead die 251 can be mounted on a mounting substrate in some configurations that is located between the printhead die 251 and the manifold 247. In some configurations, such as shown in FIG. 4A, the manifold 247 is the mounting substrate.

A method of air extraction from printhead 250 can be described with reference to FIG. 2 and FIG. 4A. Carriage 200 is moved toward wall 306 along carriage scan direction 305 until bellows 222 is compressed by projection 340 along compression direction 223, which is parallel to carriage scan direction 305. Bellows 222 is an example of a carriage-motion-activated pressure mechanism. At least a portion of the bellows 222 is movable along the carriage motion direction (i.e. carriage scan direction 305) relative to carriage 200. Air that had been in bellows 222 is forced into air expulsion chamber 232, thereby raising the pressure in that chamber such that normally closed one-way relief valve 224 is forced open and a quantity of air is expelled. Then one-way relief valve 224 closes again. After carriage 200 moves away from wall 306, bellows 222 can expand. As bellows 222 expands, the total volume in bellows 222 and air expulsion chamber 232 increases. Since pressure is inversely proportional to volume of a gas, the pressure in air expulsion chamber 232 decreases as bellows 222 expands. When the pressure in air expulsion chamber 232 becomes sufficiently less than the pressure in air accumulation chamber 230 then one-way containment valve 228 is forced open, some air passes from air accumulation chamber 230 to air expulsion chamber 232 through air passage 231. This reduces the pressure in air accumulation chamber 230 (while tending to raise the pressure in air expulsion chamber 232) until one-way containment valve 228 closes, and the air passage 231 is sealed again so that no more air can pass between air accumulation chamber 230 and air expulsion chamber 232. The reduced air pressure in air accumulation chamber 230 is applied to membranes 236-239. In other words, the pressure in air accumulation chamber 230 is lower than the pressure in ink reservoirs 241-244. As a result, air is drawn from ink reservoirs 241-244 through membranes 236-239, thus extracting air from ink reservoirs 241-244 of printhead 250. As bellows 222 continues to expand and air continues to be drawn from ink reservoirs 241-244 into air accumulation chamber 230, the pressure in air accumulation chamber 230 can again exceed that in air expulsion chamber 232 sufficiently to force one-way containment valve 228 open, thereby bringing the pressure in air accumulation chamber 230 to a reduced level again. When the carriage 200 is moved toward wall 306 again to engage projection 340 to compress bellows 222, air that has been transferred to air expulsion chamber 232 and bellows 222 from air accumulation chamber 230 is expelled through one-way relief valve 224, thereby removing air from the ink reservoirs 241-244 via the air accumulation chamber 232. Typically, during compression of bellows 222, the one-way containment valve 228 is in its normally closed position. However, if one-way containment valve 228 happens to be open when bellows 222 begins to be compressed, increased pressure in air expulsion chamber 232 will cause one-way containment valve 228 to close, so that pressure further builds up in air expulsion chamber 232, forcing air out air vent 226.

Some preferred geometrical details are also shown in FIG. 4A. The air accumulation chamber 230 of air extraction chamber 220 has a length dimension L1 along compression direction 223. The distance L2 from an outermost edge of a first membrane (such as membrane 236) to an opposite outermost edge of a second membrane (such as membrane 239) is preferably less than L1. In that way, a single air extraction chamber 220 can draw air from a plurality of ink reservoirs through a corresponding plurality of membranes. In FIG. 4A, one air extraction chamber 220 is able to provide air management for four ink reservoirs 241-244, since the air accumulation chamber 230 is able to provide a reduced pressure to the corresponding four membranes 236-239.

Nozzle arrays 257 are disposed along nozzle array direction 254 that is substantially parallel to media advance direction 304. Nozzle array separation direction 258 is substantially parallel to carriage scan direction 305. In order to simplify connection of inks from ink reservoir ink outlets 246 to printhead die ink inlets 256, therefore, ink reservoirs 241-244 are preferably displaced from one another along carriage scan direction 305. Since compression direction 223 of bellows 222 is also substantially parallel to carriage scan direction 305, ink reservoirs 241-244 are preferably displaced from each other along a direction that is substantially parallel to compression direction 223. Also, since carriage scan direction 305 is substantially perpendicular to media advance direction 304, it follows that compression direction 223 is substantially perpendicular to array direction 254. Furthermore, with reference to FIG. 2, the plane of print zone 303 of printer chassis 300 is substantially parallel to both carriage scan direction 305 and media advance direction 304. When printhead 250 is mounted in printhead chassis 300, membranes 236-239 are preferably substantially vertically above ink outlets 248, printhead die ink inlets 256 and inlet ports 245 in order to facilitate air bubbles rising through the ink, as described below. In other words, it is preferred that membranes 236-239 be displaced from nozzle arrays 257 (i.e. from the arrays of drop ejectors) along a membrane displacement direction 235 that is substantially perpendicular to both array direction 254 and compression direction 223.

Figure 3:
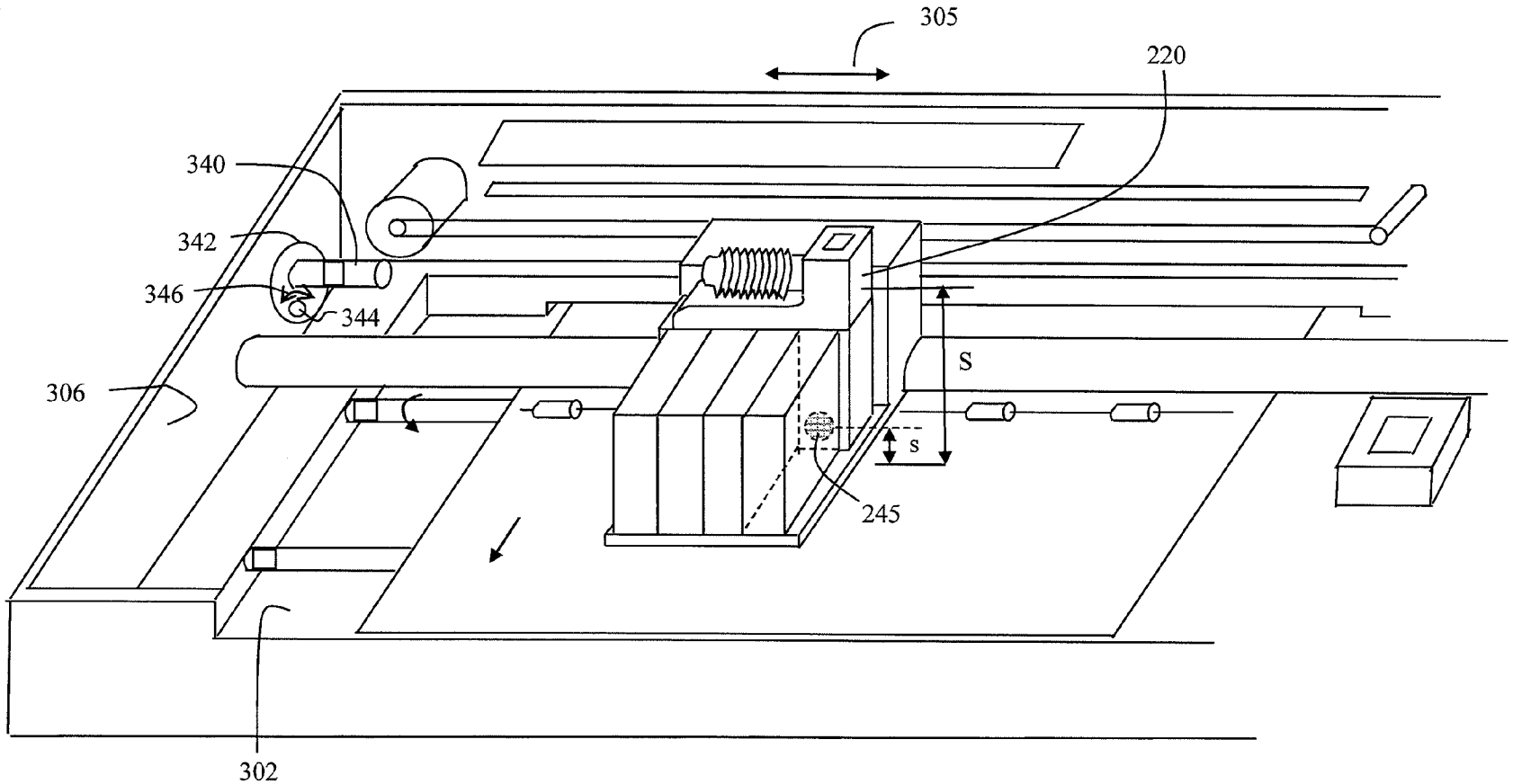
FIG. 3 is a schematic perspective similar to FIG. 2, with a projection rotated out of engagement alignment.
Figure 5B:
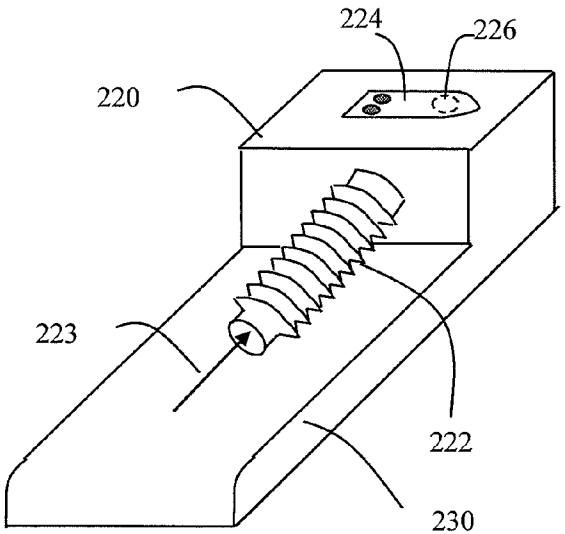
FIG. 5B is a perspective side view of the air extraction chamber of FIG. 4A.
Figure 5A:
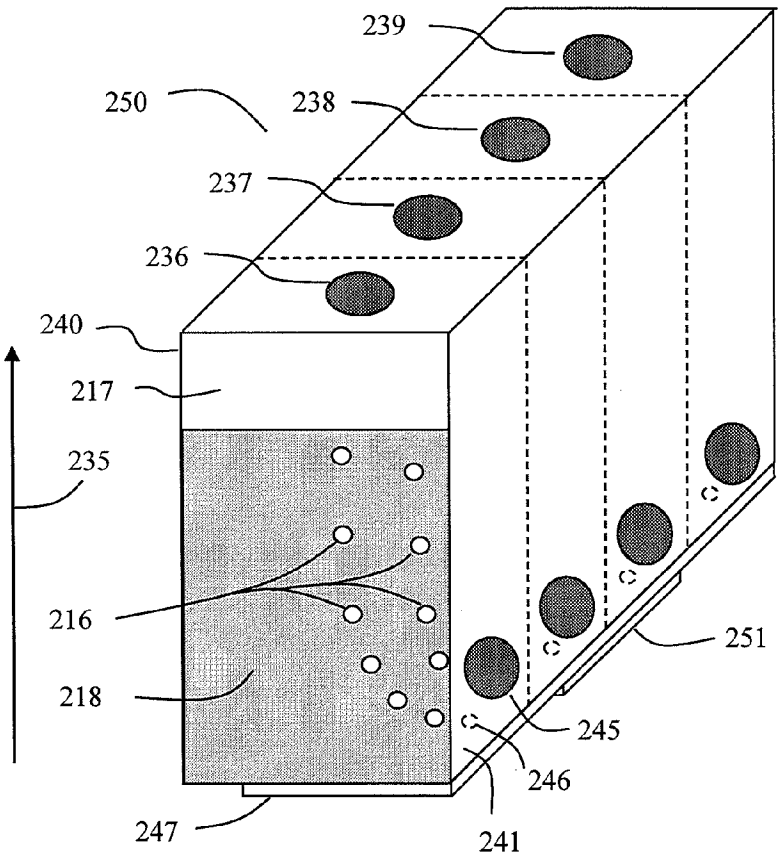
FIG. 5A is a perspective side view of a printhead similar to that of FIG. 4A.

FIG. 5A shows a perspective of a printhead 250 similar to that of FIG. 4A, but rotated about an axis parallel to membrane displacement direction 235. FIG. 5B is similarly a rotated view of air extraction chamber 220. The view of FIG. 5A looks through a side wall of ink reservoir 241 and shows air bubbles 216 rising through liquid ink 218 in a direction substantially parallel to membrane displacement direction 235. Air bubbles 216 rise both from ink outlets 246 and from inlet ports 245 of printhead 250. Air bubbles 216 originating at ink outlet 246 can come, for example, from printhead die 251 due to air that is exsolved from the ink 218 at elevated temperatures. Air bubbles 216 originating at inlet ports 245 can enter, for example, during the changing of ink tanks 262 (see FIG. 2). Air extraction chamber 220 is effective in extracting bubbles from both sources. The open vertical geometry of ink reservoir 241, leading to an air space 217 above free liquid ink 218 and from the air space 217 to membrane 236, facilitates the free rising of air bubbles 216 through liquid ink 218, due to their buoyancy, toward the air space 217 and membrane 236. Another way of describing such a vertical geometry, with reference also to FIG. 3, is that a distance s between the inlet port 245 of the ink reservoir 241 and the support base 302 of printer chassis 300 is less than a distance S between air extraction chamber 220 and support base 302. Similarly, a distance between the ink outlet 246 of ink reservoir 241 and the support base 302 of printer chassis 300 is less than the distance S between air extraction chamber 220 and support base 302 (although the ink outlet 246 is not shown in FIG. 3 for clarity).

Figure 6B:
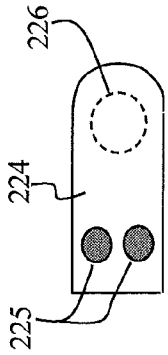
FIG. 6B is an example of a one-way valve.
Figure 6A:
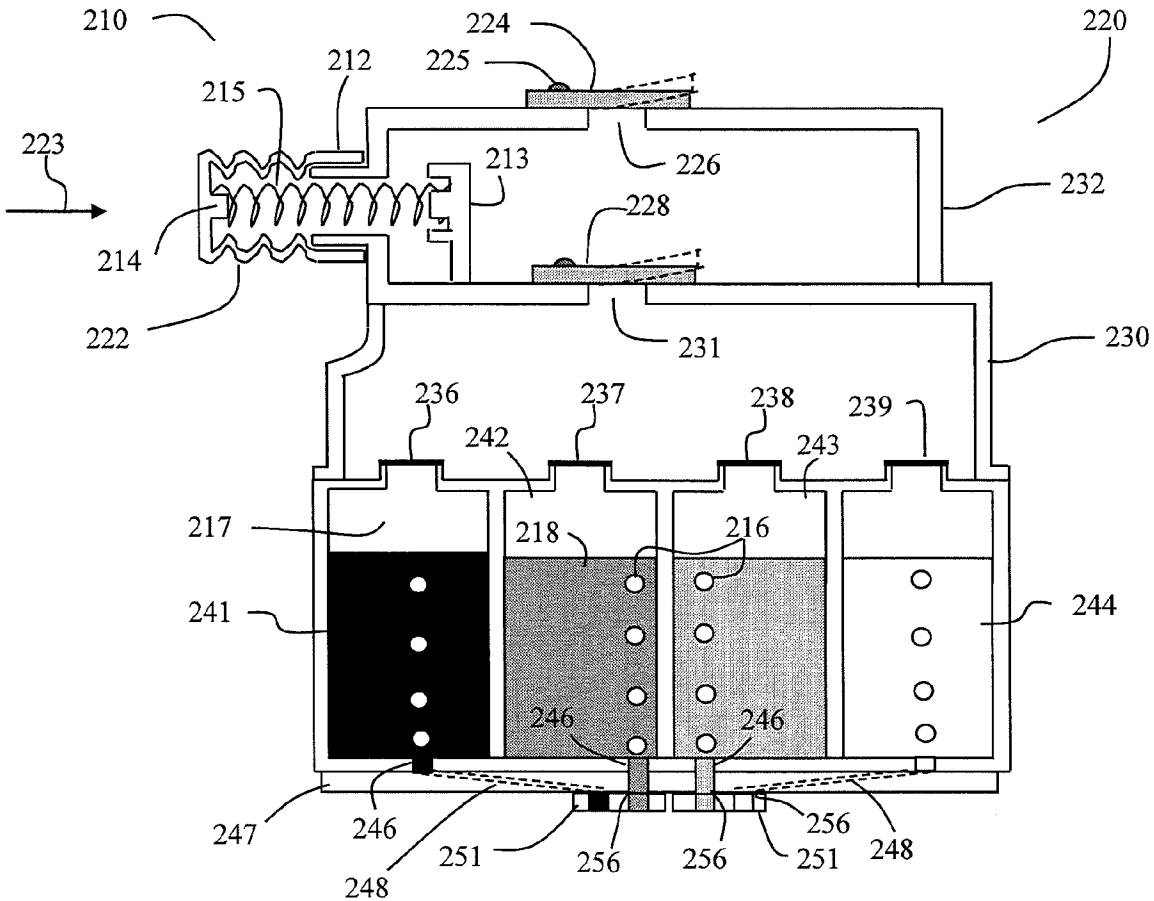
FIG. 6A is cross-sectional view of a printhead assembly.

FIG. 6A is a cross-sectional view of a printhead assembly 210. In this configuration, a compression spring 215 is held between a fixed support 213 within air expulsion chamber 232 and a movable support 214 near the end of bellows 222. Compression spring 215 helps bellows 222 to expand after bellows 222 has been compressed along compression direction 223. In some other configurations, bellows 222 is made of materials having sufficient elastic properties to provide the expansion forces needed for bellows expansion without use of a compression spring. Providing compression spring 215 within bellows 222 can permit the use of cheaper or otherwise more optimal materials for making bellows 222. The non-moving end 212 of bellows 222 is affixed to air expulsion chamber 232, such that air is freely flowable between the interior of bellows 222 and the interior of air expulsion chamber 232.

FIG. 6A illustrates the open positions and the closed positions of both one-way relief valve 224 and one-way containment valve 228 for the case where both are flapper valves of the type shown in FIG. 6B. The normally closed position of one-way relief valve 224 against air vent 226 is shown by the gray-shaded solid line rectangle. The open position away from air vent 226 is shown by the dashed lines. Similarly, the normally closed position of one-way containment valve 228 against air passage 231 is shown by the gray-shaded solid line rectangle, while the open position away from air passage 231 is shown by the dashed lines.

It is not required that the seals in air extraction chamber 220 be airtight. Including the effects of air entering air extraction chamber 220 from ink reservoirs 241-244 through membranes 236-239, and leaks at various seals, the time constant for loss of pressure differential between ambient pressure and pressure in air extraction chamber 220 can be between about 5 seconds and about one hour in various configurations.

FIG. 6A shows air bubbles 216 rising freely from ink outlets 246 in ink reservoirs 241-244 through free liquid ink 218 toward air space 217 above liquid ink 218. For inner ink reservoirs 242 and 243, the entire ink pathway from printhead die ink inlets 256, through manifold 247 to ink inlets 256 to air space 217 to air extraction chamber 220 is substantially vertical and this is preferred for movement of air bubbles 216. In order to reduce the costs of printhead die 251 and in order to provide sufficient ink in ink reservoirs 241-244, it will generally be true that the distance between outermost ink inlets 256 will be somewhat less than the distance between outermost ink reservoirs 241 and 244, so that for configurations such as that shown in FIG. 6A, the outer manifold passageways 248 will have a portion with a slight incline from horizontal.

Figure 7B:
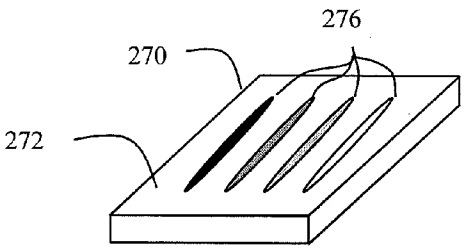
FIG. 7B is a perspective of a side of the mounting substrate of FIG. 6A having outlet openings for connection to the printhead die.
Figure 7A:
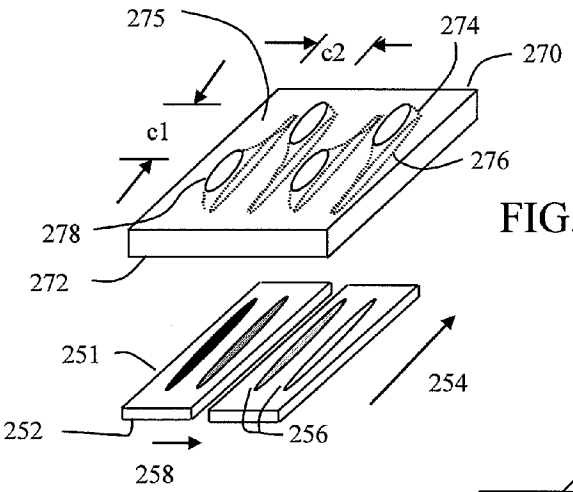
FIG. 7A is an exploded perspective of a mounting substrate and two printhead die.
Figure 7C:
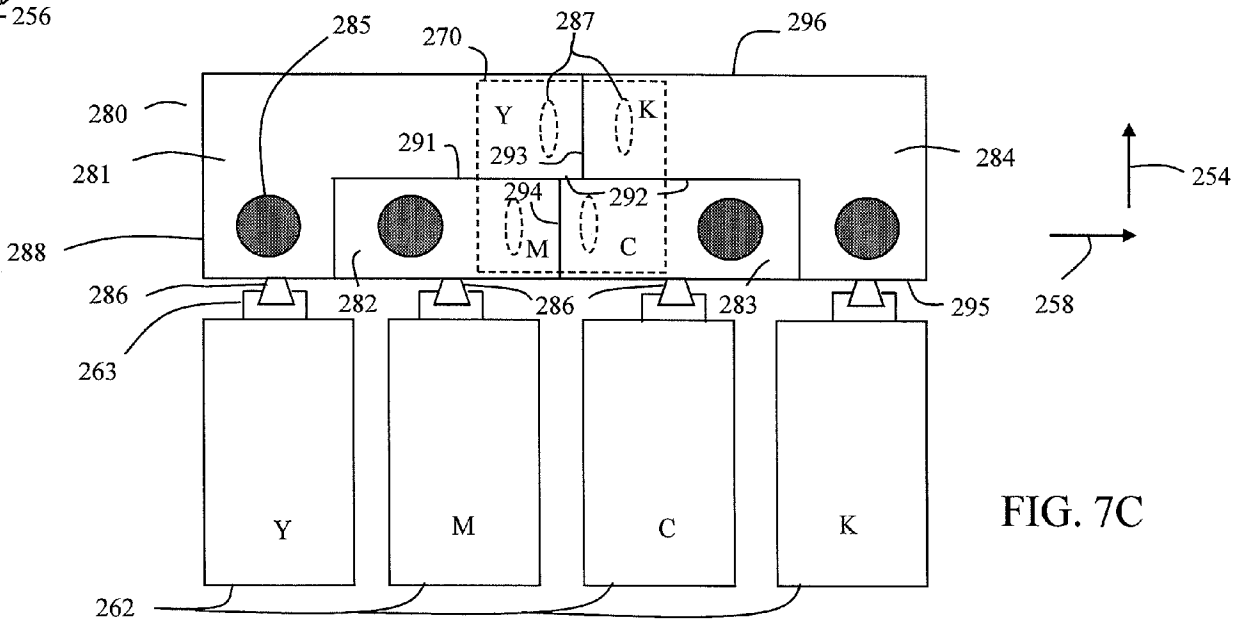
FIG. 7C is schematic top view of a portion of a printhead and ink tanks.

In other configurations, a wrap-around ink reservoir geometry illustrated in FIG. 7C can be used in order to provide a more vertical pathway in the printhead for air bubble flow all the way from the printhead die 251 to the air space 217 above the liquid ink 218, even for the outside ink reservoirs. The wrap-around ink reservoir geometry is particularly compatible with printhead die configurations, as shown in the exploded view of FIG. 7A, where the ink inlets 256 are longer along nozzle array direction 254 than the spacing between ink inlets 256 along the array separation direction 258. Two trends make this printhead die configuration more advantageous. Printing speed is increased by providing a longer print swath, i.e. a longer nozzle array length. Printhead die cost is decreased by shrinking the area of the die. Therefore, to provide a low cost, high speed printhead, it is advantageous to have the nozzle arrays longer than the spacing between nozzle arrays. In the configuration shown in FIG. 7A, there are two printhead die 251, each having two nozzle arrays on nozzle face 252, and corresponding ink inlets 256 on the face opposite nozzle face 252. The ink inlet faces of printhead die 251 are sealingly affixed to the die bonding face 272 of mounting substrate 270, typically with an ink-compatible die bonding adhesive to provide fluid connection. Mounting substrate 270 includes mounting substrate passages 274 for providing ink from the ink reservoirs of the printhead to the printhead die. In the configuration shown in FIG. 7A, mounting substrate passages 274 are shoe-shaped. On the die bonding face 272 of mounting substrate 270, the mounting substrate passages 274 exit as elongated outlet openings 276 (see FIG. 7B), suitable for mating to similarly shaped ink inlets 256 of printhead die 251. On the printhead mounting face 275 of mounting substrate 270, mounting substrate passages 274 exit as smaller inlet openings 278 that are alternately staggered from one another along a nozzle array direction 254. In other words, the displacement between two adjacent inlet openings 278 has a component c1 that is parallel to array direction 254, and a component c2 that is parallel to array separation direction. In many cases, c1 is greater than c2. To provide the staggered configuration of inlet openings 278 in the configuration shown in FIG. 7A, adjacent shoe-shaped mounting substrate passages 274 are oriented oppositely to one another. Elongated outlet openings 276 are fluidly connected to smaller inlet openings 278 by the portions of mounting substrate passages 274 that are internal to the mounting substrate 270.

The wrap-around ink reservoir geometry of printhead 280 is illustrated in the top view shown in FIG. 7C. Printhead body 288 includes a plurality of ink reservoirs 281-284 and a linear arrangement of inlet ports 286 for ink reservoirs 281-284. Printhead body 288 includes a first outer wall 295 and a second outer wall 296 opposite the first outer wall 295. First outer wall 295 is located proximate (i.e. at or near) the inlet ports 286, while second outer wall 296 is distal to the inlet ports 286. In this configuration, the outer ink reservoirs 281 and 284 are L-shaped and wrap around the inner ink reservoirs 282 and 283. As a result, outer ink reservoirs 281 and 284 each have a first portion located near first outer wall 295 and second portion located near second outer wall 296. Inner ink reservoirs 282 and 283 each have a portion located near first outer wall 295, but no portion located near second outer wall 296. Each ink reservoir has an air permeable membrane 285 that is not permeable to liquid, an inlet port 286, and an ink outlet 287. Ink outlets 287 are arranged on a bottom face of ink reservoirs 281-284 in the same staggered configuration as the smaller inlet openings 278 on printhead mounting face of mounting substrate 270. Each ink outlet 287 of the ink reservoirs 281-284 can be fluidly connected to a corresponding inlet opening 278 on mounting substrate 270, for example with a gasket seal. Ink reservoirs 281-284 contain liquid ink and have an air space at the top of the ink reservoir above the liquid ink, similar to the relationship of liquid ink 218 and air space 217 that is shown in FIGS. 5A and 6A. Because there is a substantially vertical travel pathway for air bubbles to the air space from the mounting substrate inlet openings 278 and corresponding ink outlets 287 of ink reservoirs 281-284 (for outer ink reservoirs 281 and 284 as well as inner ink reservoirs 282 and 283), air bubble movement to the air space is not impeded. In fact, the vertical travel pathway extends to ink inlets 256 of printhead die 251, where the ink inlets 256 correspond to nozzle arrays 257 (see FIG. 4B). In addition, because there is a substantially vertical travel pathway for air bubbles to the air space from the inlet ports 286, air bubble movement from the inlet ports 286 to the air space at the top of the corresponding ink reservoirs is also not impeded. The position of membranes 285 within ink reservoirs 281-284 is not critical, as long as membranes 285 are in contact with the air space of the corresponding ink reservoir, and as long as the membranes can fit within the air extraction chamber dimensions.

In the configuration shown in FIG. 7C, ink reservoir 281 has an inlet port 286 that is adjacent to the inlet port 286 of ink reservoir 282. Because of the staggered configuration of ink outlets 287, and the wrap-around ink reservoir geometry of printhead 280, the ink outlet 287 of ink reservoir 281 is displaced from the ink outlet 287 of ink reservoir 282, such that the displacement between the two outlets 287 has a component c1 that is parallel to the nozzle array direction 254 and a component c2 that is parallel to the array separation direction 258 (see also FIG. 7A). Other implications of the wrap-around ink reservoir geometry have to do with the configuration of inner walls shared between ink reservoirs. In the discussion that follows, the numbering convention for the ink reservoirs 281, 282, 283 and 284 (i.e. first, second, third and fourth respectively) is based on the position of the corresponding inlet ports for those ink reservoirs. The inlet port 286 of the second ink reservoir 282 (the first inner reservoir) is between the inlet port 286 of the first ink reservoir 281 (the first outer reservoir) and the inlet port 286 of the third ink reservoir 283 (the second inner reservoir). Similarly, the inlet port 286 of the third ink reservoir 283 (the second inner reservoir) is between the inlet port 286 of the second ink reservoir 282 (the first inner reservoir) and the inlet port 286 of the fourth ink reservoir 284 (the second outer reservoir). Wall 291 is shared between first ink reservoir 281 and second ink reservoir 282. After wall 291 intersects wall 294 that is shared between second ink reservoir 282 and third ink reservoir 283, wall 291 further extends to a wall 292 that is shared between the first ink reservoir 281, the second ink reservoir 282 and the third ink reservoir 283. Wall 292 is also shared between the third ink reservoir 283 and the fourth ink reservoir 284. Wall 293, which intersects second outer wall 296, is shared between the first ink reservoir 281 and fourth ink reservoir 284. Wall 293 is substantially perpendicular to wall 292.

In the configuration shown in FIG. 7C, tank ports 263 of dismountable ink tanks 262 are fluidly connected to respective inlet ports 286 of ink reservoirs 281-284. From left to right along the array separation direction 258 in FIG. 7C, the order of the different color inks supplied to inlet ports 286 of ink reservoirs 281-284 is YMCK (yellow, then magenta, then cyan, and then black). A consequence of the wrap-around ink reservoir geometry of printhead 280, is that the ink outlets 287 of ink reservoirs 281-284 are arranged in a different order MYCK along array separation direction 258.

Figure 8:
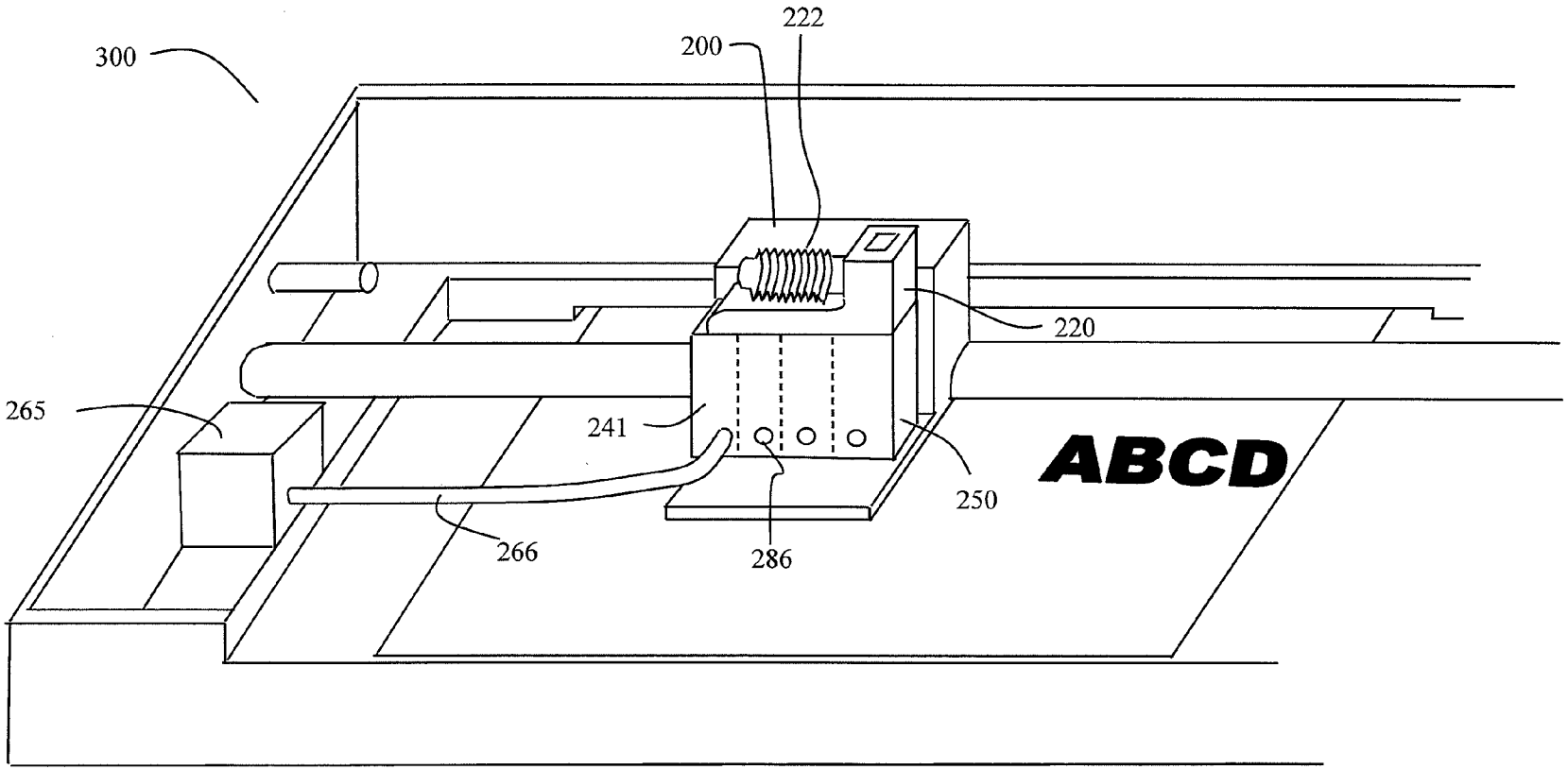
FIG. 8 is a schematic perspective of a portion of a carriage printer.

FIG. 8 shows where ink is supplied to the ink reservoir 241 of printhead 250 from a remote ink supply 265 that is mounted stationarily on printhead chassis 300, rather than from ink tanks that are mounted on movable carriage 200. Ink is supplied to ink reservoir 241 through flexible tubing 266 which is connected to inlet port 286. For clarity, flexible tubing 266 is shown connected only to one of the four inlet ports in FIG. 8. Air extraction chamber 220 operates in a similar fashion as described above relative to other configurations.

Figure 9:
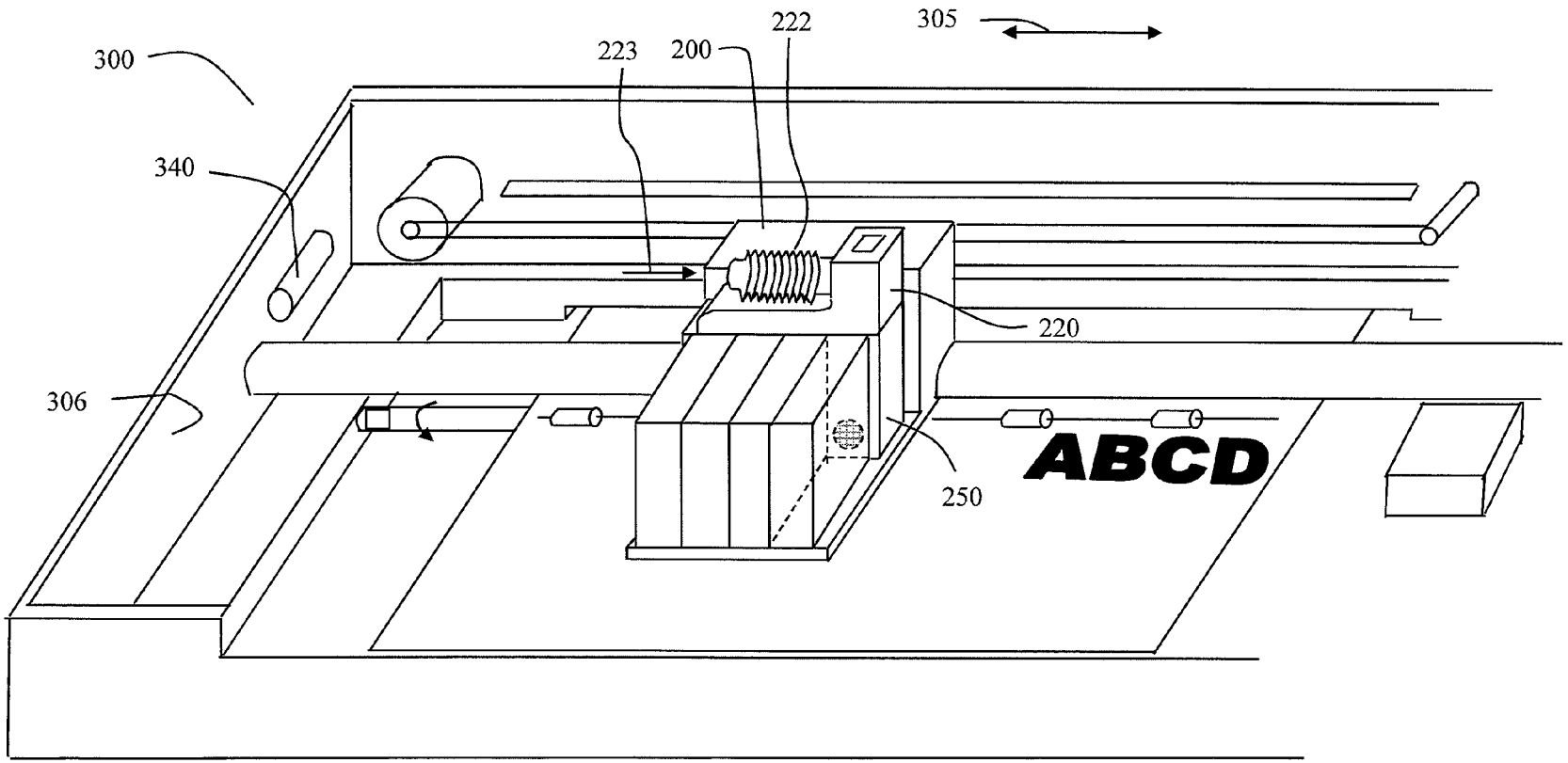
FIG. 9 is a schematic perspective of a portion of a carriage printer.

FIG. 9 shows a configuration that moves projection 340 into and out of engageable alignment with bellows 222 in a different fashion than described above relative to FIGS. 2 and 3. In the configuration of FIG. 9, projection 340 is pivotably mounted to wall 306. When it is desired to compress bellows 222 along compression direction 223, projection 340 is oriented extending outwardly from wall 306 along a direction substantially parallel to carriage scan direction 305 as in FIG. 2. When it is desired to move projection 340 out of alignment with bellows 222, it is pivoted against wall 306 as shown in FIG. 9, so that projection 340 is in an orientation that is not substantially parallel to carriage scan direction 305.

Figure 10:
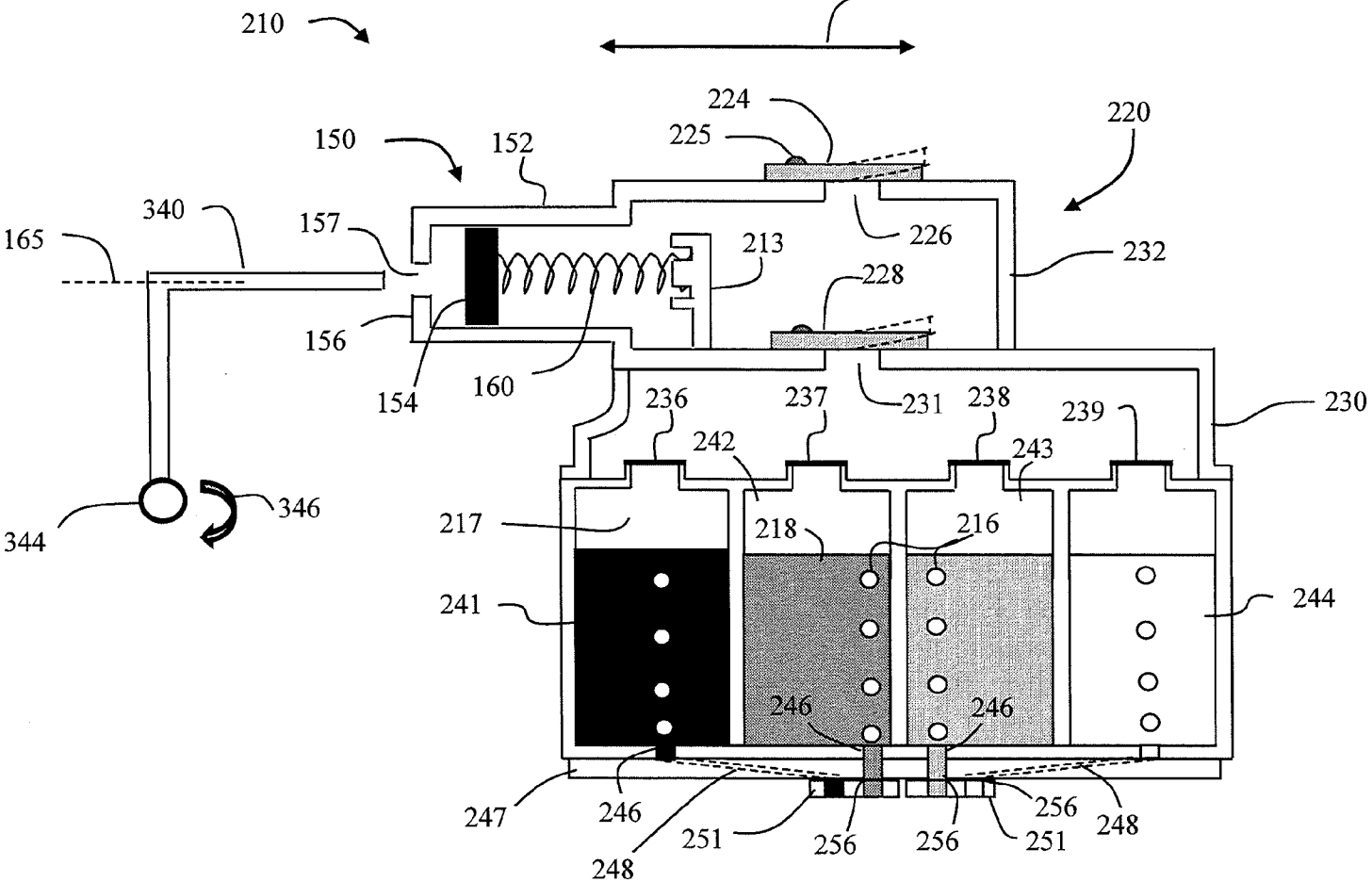
FIG. 10 is a cross-sectional view of a printhead assembly including a piston assembly.
Figure 11:
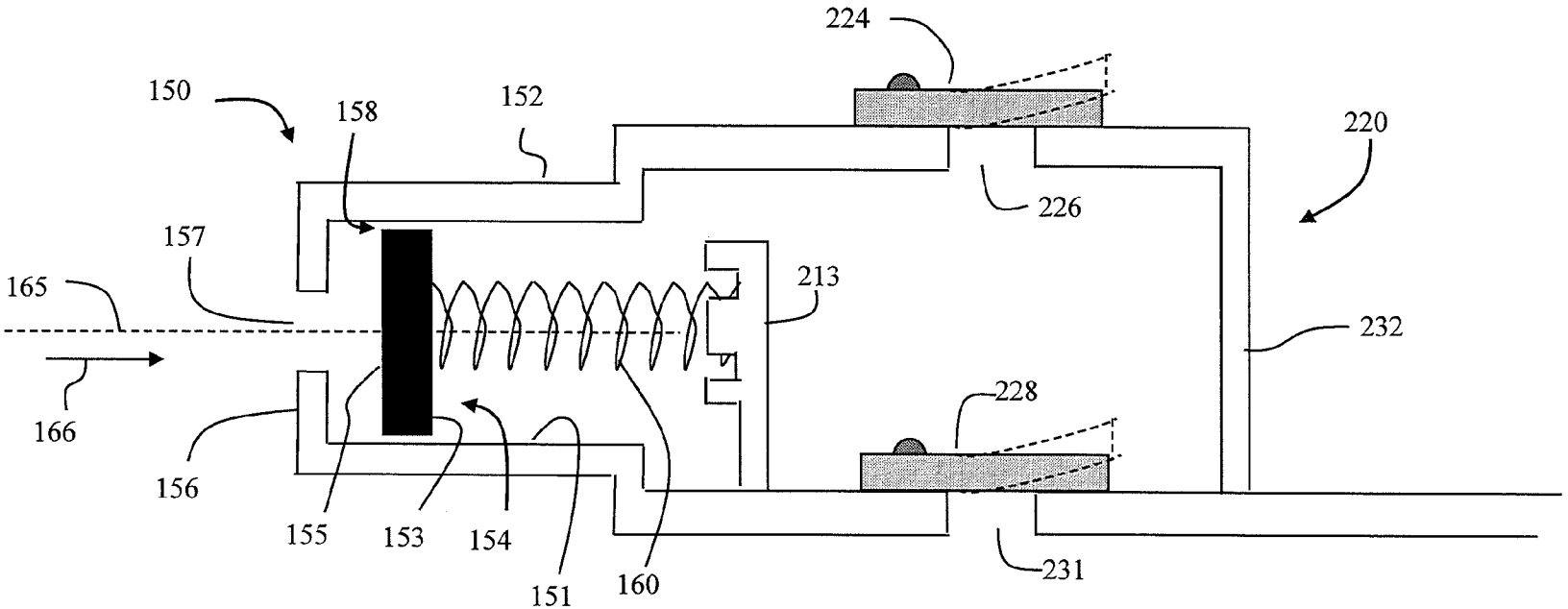
FIG. 11 is a close-up of a portion of FIG. 10, including the piston assembly.

While a compressible member such as bellows 222, is well suited for forcing air to be vented from air expulsion chamber 232 through the one-way relief valve 224 in its open position, and for applying a reduced air pressure to the membranes 236-239, while the one-way relief valve 224 is in its closed position as described above, in some applications it can be preferable to use a piston assembly 150, as shown in FIGS. 10 and 11 rather than a compressible member such as bellows 222. In the example of a printhead assembly 210 shown in FIG. 10 (similar to FIG. 6A but with piston assembly 150 used instead of bellows 222), piston assembly 150 includes a cylinder 152, a disk 154 disposed within the cylinder 152, a spring 160 in contact with a first side 153 of disk 154, an end wall 156 that is affixed to cylinder 152, and an opening 157 in end wall 156 that is near a second side 155 of disk 154. Unlike compressible bellows 222 of FIG. 6A, cylinder 152 is rigid. Disk 154 is configured to move within cylinder 150 along axis 165 to increase or decrease the pressure of air in air expulsion chamber 232. Axis 165 is the axis of motion of the piston assembly 150 and is parallel to carriage scan direction 305, so that disk 154 is movable along the carriage motion direction relative to the carriage. Motion of disk 154 in a direction 166 to compress spring 160 toward fixed support 213 causes compression of air in air expulsion chamber 232, thereby causing one-way relief valve 224 to move to its open position in order to vent air through air vent 226. Elastomeric restoring force then closes one-way relief valve 224. Subsequent expansion of spring 160 causes disk 154 to move toward end wall 156, causing a reduction in pressure in the air expulsion chamber 232. When the pressure in air accumulation chamber 230 is greater than the pressure in air expulsion chamber 232 by a sufficient amount to force one-way containment valve 228 open, air is transferred from air accumulation chamber 230 to air expulsion chamber 232 through air passage 231. Then elastomeric restoring force closes the one-way containment valve 228 again.

As shown in FIG. 10, air extraction chamber 220 is typically located above the ink outlets 246 of the ink reservoir 241-244 so that air bubbles 216 can freely rise through the liquid ink 218 from the ink outlets 246 of the ink reservoirs 241-244 toward air extraction chamber 220.

Figure 12:
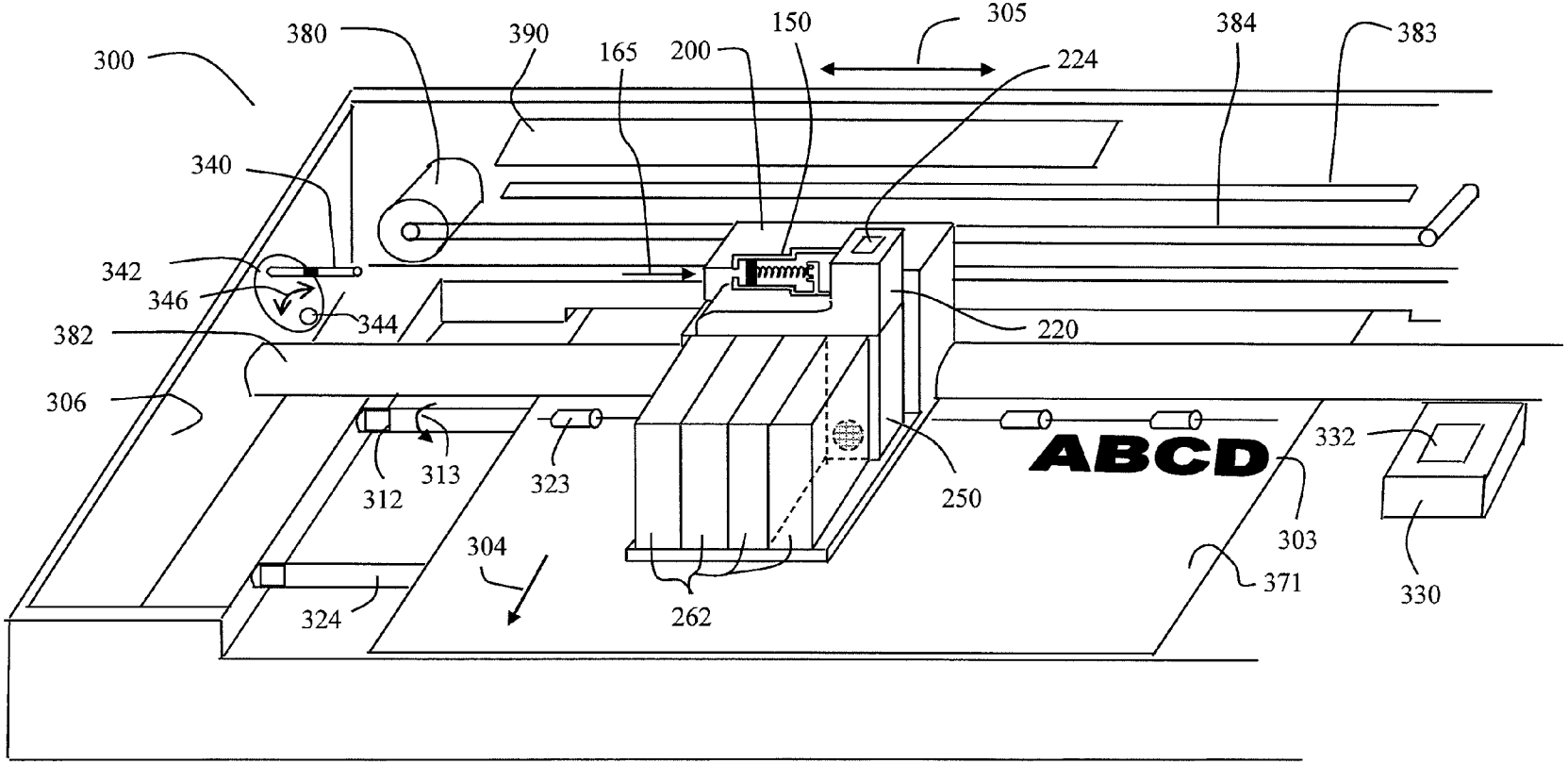
FIG. 12 is a schematic perspective of a portion of a carriage printer configured to extract air from the printhead assembly of FIG. 10 with the piston assembly shown in a cut-away view.

With reference to FIGS. 10-12, in order to compress spring 160 toward fixed support 213, carriage 200 is moved toward wall 306 so that projection 340 enters opening 157 in end wall 156 of piston assembly 150. Projection 340 is oriented along axis 165, and so is spring 160. Projection 340 then contacts second side 155 of disk 154. Continued motion of carriage 200 along carriage scan direction 305 toward the end of the carriage scan path near projection 340 causes spring 160 to compress. In other words, piston assembly 150 is another example of a carriage-motion-activated pressure mechanism. Because the position of carriage 200 is tracked relative to linear encoder 383, the amount of movement of carriage 200 toward wall 306 can be precisely controlled, thereby controlling the amount of compression of spring 160.

In a preferred configuration, cylinder 152 is a right circular cylinder and disk 154 is a circular disk. Such circular geometries are more readily manufacturable than noncircular geometries. In addition, circular geometries facilitate smooth motion of the disk 154 without rubbing of portions of disk 154 against inner surface 151 of cylinder 152 if disk 154 rotates as it moves within cylinder 152. It is not required that disk 154 have an airtight seal against inner surface 151 of cylinder 152. In fact, for ease of motion of disk 154 within cylinder 152, it is typically preferred to configure disk 154 with a slightly smaller diameter than the diameter of the inside of cylinder 152 (by on the order of 0.1 mm), such that there is an air passageway 158 (FIG. 11) between an edge surface of disk 154 and inner surface 151 of cylinder 152. Including the effects of air entering air extraction chamber 220 from ink reservoirs 241-244 through membranes 236-239, leaks through air passageway 158, and leaks at one-way relief valve 224 and various other leaks, the time constant for loss of pressure differential between ambient pressure and pressure in air extraction chamber 220 can be between about 5 seconds and about one hour.

Other features of inkjet printhead assembly 210 having a piston assembly 150 are similar to previously described features of printhead assembly 210 having a compressible member such as a bellows 222. In particular, inkjet printhead assembly 210, in addition to including a piston assembly 150, also includes at least one array of nozzles 257 disposed along an array direction 254 (FIG. 4B) with a corresponding ink inlet 255; at least one ink reservoir 241-244 that is fluidically connected to ink inlet 257; at least one membrane 236-239 that is permeable to air but is not permeable to liquid; and an air extraction chamber 220 including an air chamber and a one-way relief valve 224. Air extraction chamber 220 typically includes an air expulsion chamber 232 near one-way relief valve 224, an air accumulation chamber 230, and a one-way containment valve 228 between air accumulation chamber 230 and air expulsion chamber 232.

Inkjet printhead assembly 210 can include at least one dismountable ink tank 262 including a tank port 263 that is fluidly connectable to a corresponding inlet port 286 of an ink reservoir 281 (as in FIG. 7C). Alternatively, as in FIG. 8, ink can be supplied to the ink reservoir 241 of printhead 250 from a remote ink supply 265 that is mounted stationarily on printhead chassis 300, rather than from ink tanks that are mounted on movable carriage 200. Ink is then supplied to ink reservoir 241 through flexible tubing 266 which is connected to inlet port 286. For an inkjet printhead assembly 210 including a first ink reservoir and a second ink reservoir, the second ink reservoir can be displaced from the first ink reservoir along a direction that is substantially parallel to the axis of motion 165 of piston assembly 150. Axis of motion 165 of printhead assembly 150 is typically substantially perpendicular to nozzle array direction 254. Membrane 236 is typically displaced from nozzle array 257 along a direction 235 (FIG. 5A) that is substantially perpendicular to both nozzle array direction 254 and axis of motion 165 of piston assembly 150.

Whether air is removed by an air extraction device including a bellows 222 or a piston assembly, or by other techniques, and whether the ink reservoirs are in a side by side configuration as in FIG. 4A or in a wrap-around configuration as in FIG. 7C, there can be places in the ink passageways where air bubbles 216 can become stuck. This can be a significant problem when the ink passageway is small and the air bubbles 216 obstruct ink flow. In particular, relative to FIGS. 7A to 7C, air bubbles 216 can become stuck near ink inlets 256 of printhead die 251, or near ink inlet openings 278 of printhead mounting substrate 270, which are fluidically connected to ink outlets 287 of ink reservoirs 281-284. Since these ink passageways, which are fluidically connected to the ink feeds 255 and nozzle arrays 257 (FIG. 4B), are small relative to the dimensions of the free ink reservoirs 281-284, an air bubble that is stuck in such a location can result in misfires and print degradation, because sufficient ink is not provided quickly enough to the nozzle array 257. Embodiments of the present invention will next be described for dislodging such air bubbles by causing the carriage 200 to oscillate. The dislodged air bubbles 216 (FIGS. 5A and 6A) can then move through ink inlet 256 or ink inlet opening 278 and rise vertically through the free ink reservoirs 281-284 or 241-244 that are disposed above the array(s) of nozzles 257 located on printhead die 251 when the inkjet printhead 250 and ink reservoirs are installed in the printer. Air corresponding to the air bubbles 216 can then be removed by the air extraction device as described above.

Figure 13:
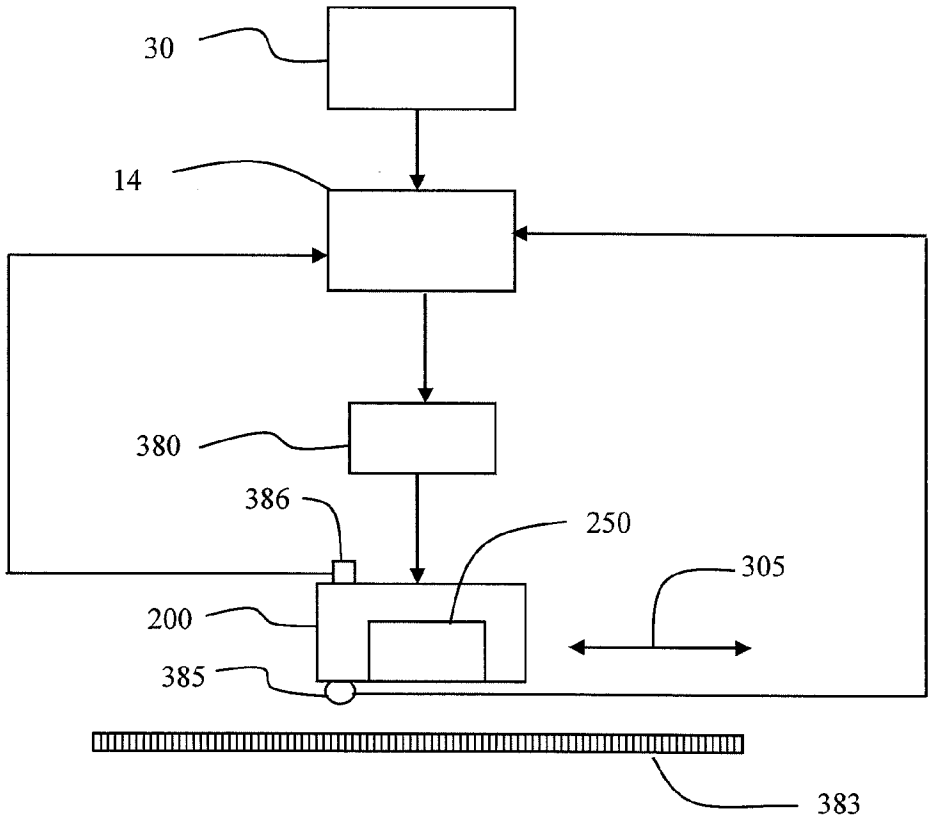
FIG. 13 is a block diagram of a motion control system for the carriage, according to an embodiment of the invention.

FIG. 13 shows a block diagram of the motion control system for carriage 200. Carriage 200 moves printhead 250 back and forth along carriage scan direction 305. A linear encoder 383 is disposed along carriage scan direction 305. Encoder sensor 385 is mounted on carriage 200 and senses the regularly spaced black and white transitions on linear encoder 383. Encoder sensor 385 sends signals corresponding to the black and white transitions to controller 14. Controller 14 controls carriage motor 380 to rotate in forward or reverse directions by amounts to move the carriage 200 at a speed and direction as needed. When printhead 250 is printing in print region 303 (FIG. 12 for example), controller 14 controls the carriage motor 380 with a first control mode such that vibrations of carriage 200 are damped, thereby providing a more uniform velocity. In that way, ink drops can be more controllably ejected toward their appropriate locations on recording medium 371 in order to provide excellent image quality. At selected times (e.g. selected by controller 14) when printhead 250 is not printing, controller 14 implements a second motion control mode that sets carriage 200 into oscillation in order to dislodge air bubbles for removal from printhead 250.

Controller 14 can include a digital servo that uses error-sensing feedback to control carriage motion in the various motion control modes. Carriage position is interpreted by controller 14 based on the signals sent by encoder sensor 385. Any difference between the actual and desired position (an error signal) is amplified and used to drive the carriage motor 380 in the direction necessary to reduce or eliminate the error. In addition to controlling carriage position, the digital servo can determine and control carriage velocity by monitoring carriage position by the signals from encoder sensor 385 as a function of time, based on signals from clock 30. Differences between actual and desired velocity provide a second error signal that is amplified to drive the carriage motor in such a way as to provide a uniform desired velocity in the print region 303, for example. One source of undesirable carriage vibration during printing that is desired to be damped out is due to cogging of carriage motor 380, as described in US Patent Application Publication 20100054835. A DC motor is typically used for carriage motor 380. Since a DC motor has a gap between the magnetic poles of the stator, the shaft of the motor is unstable for smooth rotation so that cogging vibration tends to be generated. Appropriate control from controller 14 can damp out cogging vibration or other sources of velocity nonuniformity.

Controller 14 can include a proportional-integral-derivative control section (a PID controller) for controlling the velocity and position of the carriage. A PID control algorithm operates using a first term P that depends upon the present error, a second term I that depends upon the accumulation of past errors, and a third term D that is a prediction of future errors based on current rate of change. The weighted sum of these three terms is used to control carriage motor 380 based on position signals provided by encoder sensor 385 and time signals provided by clock 30. The proportional term makes a change to the output that is proportional to the current error value. The proportional response can be adjusted by multiplying the error by a constant $K_p$ called the proportional gain. A high proportional gain results in a large change in the output for a given change in the error. If the proportional gain is too high, the system can become unstable. If the proportional gain is too low, the control action can be undesirably small when responding to system disturbances. The contribution from the integral term depends on both the magnitude of the error and the duration of the error. The integral term in a PID controller is the sum of the instantaneous error over time and gives the accumulated offset that should have been corrected previously. The accumulated error is multiplied by the integral gain $K_I$. The integral term helps the system move more quickly toward the desired state. However, if the integral gain is set too high, the system can overshoot the desired value. The derivative of the error is calculated by determining the change in the error with respect to time and multiplying this by the derivative gain $K_d$. Derivative control can be used to reduce the amount of overshoot caused by the integral component, thereby tending to dampen oscillations in the system. Proper adjustment of $K_p$, $K_I$ and $K_d$ can provide a well-controlled carriage velocity in a first motion control mode including a first level of damping for printing where carriage vibrations are damped.

In a second motion control mode when it is desired to set the carriage 200 into oscillation for dislodging air bubbles, a second level of damping that is less than the first level is implemented by the controller 14. In the second motion control mode, controller 14 controls carriage motor 380 to move carriage 200 in a forward direction. At predetermined interrupt intervals, such as once every 1 to 2 milliseconds, signals from encoder sensor 385 are monitored and the motor current or duty cycle is adjusted appropriately. (In other words, in this example, a signal is sent from the encoder sensor 385 to the controller 14 at least 500 times per second.) Controller 14 then controls carriage motor 380 to move carriage 200 in a reverse direction. The forward and reverse motion of the carriage 200 by carriage motor 380 is repeated at a controlled frequency for a controlled duration. Proportional gain or integral gain can be increased in the second motion control mode, relative to the first motion control mode when it is desired to cause overshoot and vibration of the carriage 200. Typically, in the first motion control mode, negative feedback is used to reduce vibrations. In some embodiments, positive feedback is used in the second motion control mode to enhance carriage vibrations.

In some embodiments, the carriage 200 is driven into a resonant vibration mode. Resonant vibration modes can be particularly effective for producing large amplitude vibrations for dislodging air bubbles 216. For typical carriage masses in desktop printers and for typical carriage motors, a resonant frequency mode can be excited between 30 Hz and 300 Hz. Therefore a typical controlled frequency for driving the carriage 200 alternately in forward and reverse directions in the second motion control mode is between 30 Hz and 300 Hz. In some embodiments the controlled frequency is a predetermined single frequency that is used throughout the controlled duration. In other embodiments a range of control frequencies is used. The range of control frequencies can be between 30 Hz and 300 Hz for example. Varying the controlled frequency is sometimes called sweeping the frequency. Sweeping the frequency can be done by continuously increasing the frequency, continuously decreasing the frequency, or using other patterns of varying the frequency. An advantage of sweeping the frequency is that the carriage can be excited into one or more resonant vibration modes for shaking the air bubbles free. It does not need to take a long duration to sweep the frequency. The controlled duration can be less than one second. For example, in 0.8 second, the carriage can be driven at eight different frequencies, each for 100 msec. As a particular example, carriage 200 can be driven at 40 Hz for 4 cycles, 50 Hz for 5 cycles, 80 Hz for 8 cycles, 100 Hz for 10 cycles, 120 Hz for 12 cycles, 150 Hz for 15 cycles, 200 Hz for 20 cycles and 250 Hz for 25 cycles.

Resonant frequency of carriage 200 depends upon the mass of carriage 200. In printing systems where the ink is carried on carriage 200 and is gradually used, the mass of carriage 200 gradually decreases as ink is used. In some embodiments of the invention, the mass of carriage 200 is tracked by carriage mass monitor 386, and a corresponding signal representing a change in mass is sent to controller 14 as an input for the second motion control mode. Carriage mass monitor 386 can be a sensor, such as an optical sensor for detecting a level of ink in an ink tank. Carriage mass monitor 386 can alternatively be a calculation of a quantity of ink used in printing and maintenance operations by multiplying the number of ink drops ejected by the volume per drop and multiplying the number of maintenance cycles by the volume of ink used per cycle.

Because embodiments of this invention dislodge air bubbles and remove the resulting air without extracting ink, less ink is wasted than in conventional printers. The waste ink pad used in conventional printers can be eliminated, or at least reduced in size to accommodate maintenance operations such as spitting from the jets. This permits the printer to be more economical to operate, more environmentally friendly and more compact. Furthermore, since the carriage oscillation to dislodge air bubbles can be done in a short amount of time it is not necessary to delay printing operations significantly.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
30 Clock
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
150 Piston assembly
151 Inner surface (of cylinder)
152 Cylinder
153 First side (of disk)
154 Disk
155 Second side (of disk)
156 End wall
157 Opening
158 Air passageway
160 Spring
165 Axis
166 Direction (for spring compression)
181 Droplet(s) (ejected from first nozzle array)

182 Droplet(s) (ejected from second nozzle array)
200 Carriage
210 Printhead assembly
212 Non-moving end
213 Fixed support
214 Movable support
215 Compression spring
216 Air bubbles
217 Air space
218 Liquid ink
220 Air extraction chamber
222 Bellows
223 Compression direction
224 One-way relief valve
225 Fastener(s)
226 Air vent
228 One-way containment valve
230 Air accumulation chamber
231 Air passage
232 Air expulsion chamber
235 Membrane displacement direction
236 Membrane
237 Membrane
238 Membrane
239 Membrane
240 Printhead body
241 Ink reservoir
242 Ink reservoir
243 Ink reservoir
244 Ink reservoir
245 Inlet port(s)
246 Ink outlet
247 Manifold
248 Manifold passageway(s)
250 Printhead
251 Printhead die
252 Nozzle face
253 Nozzle array
254 Nozzle array direction
255 Ink feed
256 Ink inlet
257 Nozzle array(s)
258 Array separation direction
262 Ink tank
263 Tank port
265 Remote ink supply
266 Flexible tubing
270 Mounting substrate
272 Die bonding face
274 Mounting substrate passageway
275 Printhead mounting face
276 Outlet opening
278 Inlet opening
280 Printhead
281 Ink reservoir
282 Ink reservoir
283 Ink reservoir
284 Ink reservoir
285 Membrane
286 Inlet port
287 Ink outlet
288 Printhead body
291 Wall
292 Wall
293 Wall
294 Wall
295 First outer wall
296 Second outer wall
300 Printer chassis
302 Support base
303 Print region
304 Media advance direction
305 Carriage scan direction
306 Wall
312 Feed roller
313 Forward rotation direction (of feed roller)
323 Passive roller(s)
324 Discharge roller
330 Maintenance station
332 Cap
340 Projection
342 Projection mount
344 Shaft
346 Rotation direction
371 Piece of recording medium
380 Carriage motor
382 Carriage guide rod
383 Linear encoder
384 Belt
385 Encoder sensor
386 Carriage mass monitor
390 Electronics board

The invention claimed is:

1. A method of operating an inkjet printer including an inkjet printhead having an ink inlet, the inkjet printhead mounted on a motor-driven carriage having an encoder sensor, the method comprising:

sending a signal from the encoder sensor to a controller to indicate a position of the motor-driven carriage;

determining a velocity of the motor-driven carriage;

implementing a first motion control mode during a period when the inkjet printhead is printing, wherein the first motion control mode includes a first signal for damping vibrations in order to provide a substantially constant velocity of the carriage;

selectively implementing a second motion control mode when the inkjet printhead is not printing, wherein the second motion control mode includes a second signal for enhancing vibrations of the carriage in order to dislodge air bubbles in the printhead; and removing air corresponding to the air bubbles from the printhead.

2. The method according to claim 1, wherein implementing the first motion control mode further includes providing negative feedback.

3. The method according to claim 1, wherein implementing the second motion control mode further includes providing positive feedback.

4. The method according to claim 1, wherein the first motion control mode includes a first damping level and the second motion control mode includes a second damping level, wherein the second damping level is less than the first damping level.

5. The method according to claim 1, wherein the step of implementing the second motion control mode further including driving the carriage into a resonant vibration mode.

6. The method according to claim 1, wherein the step of implementing the second motion control mode further includes:

a) controlling the motor to move the carriage in a forward direction;

b) controlling the motor to move the carriage in a reverse direction; and c) repeating steps a) and b) at a controlled frequency for a controlled duration.

7. The method according to claim 6, wherein the controlled frequency is between 30 Hz and 300 Hz.

8. The method according to claim 6, wherein the step of repeating steps a) and b) at a controlled frequency further includes sweeping the frequency through a range of frequencies.

9. The method according to claim 8, wherein the range of frequencies is between 30 Hz and 300 Hz.

10. The method according to claim 8, wherein the controlled duration is less than one second.

11. The method according to claim 1, wherein the step of sending a signal from the encoder sensor to the controller further includes sending a signal at least 500 times per second.

12. The method according to claim 1 further including tracking a change in a mass of the carriage.

13. The method according to claim 12, wherein the step of tracking the change in the mass of the carriage further includes tracking a change in a quantity of ink being moved by the carriage.

14. The method according to claim 12 further including sending a signal to the controller related to the change in the mass of the carriage as an input for the second motion control mode.

15. The method according to claim 1 further including accumulating the removed air.

16. The method according to claim 1 further including expelling the removed air.

17. The method according to claim 1 further including changing a pressure in an air expulsion device.

18. The method according to claim 17, wherein the step of changing a pressure in an air expulsion device further includes using motion of the carriage to cause an element to move relative to the carriage along a carriage motion direction.

19. The method according to claim 18, wherein the step of using motion of the carriage to cause an element to move relative to the carriage further includes compressing a bellows.

20. The method according to claim 18, wherein the step of using motion of the carriage to cause an element to move relative to the carriage further includes pushing a piston.

21. The method according to claim 1, wherein the step of removing air further includes removing air bubbles through the ink inlet of the printhead.

22. A method for dislodging and removing air bubbles from a carriage-mounted inkjet printhead and ink supply of an inkjet printer, the method comprising:

providing a motor to move the carriage-mounted inkjet printhead and ink supply along a carriage motion direction;

controlling the motor to excite the carriage-mounted inkjet printhead and ink supply into resonant vibration to dislodge air bubbles; and expelling air corresponding to the dislodged air bubbles.

23. The method according to claim 22, wherein a frequency of resonant vibration of the carriage-mounted inkjet printhead and ink supply is between 30 Hz and 300 Hz.

24. The method according to claim 22, the inkjet printer further including a digital servo controller for the motor, wherein controlling the motor to excite the carriage-mounted inkjet printhead and ink supply into resonant vibration includes providing a selectable damping feedback parameter, wherein the damping feedback parameter is selected to be at a lower level when exciting resonant vibration than when not exciting resonant vibration.

25. The method according to claim 24, wherein controlling the motor to excite the carriage-mounted inkjet printhead and ink supply into resonant vibration includes providing a selectable gain feedback parameter, wherein the gain feedback parameter is selected to be at a higher level when exciting resonant vibration than when not exciting resonant vibration.

* * * * *